US006567065B1

(12) United States Patent
Kondoh et al.

(10) Patent No.: US 6,567,065 B1
(45) Date of Patent: May 20, 2003

(54) FERROELECTRIC LIQUID CRYSTAL DISPLAY AND METHOD OF DRIVING THE SAME

(75) Inventors: Shinya Kondoh, Tokorozawa (JP); Shigekazu Takahashi, Kawaguchi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/381,329

(22) PCT Filed: Aug. 6, 1998

(86) PCT No.: PCT/JP98/03511

§ 371 (c)(1),
(2), (4) Date: Sep. 20, 1999

(87) PCT Pub. No.: WO00/08518

PCT Pub. Date: Feb. 17, 2000

(30) Foreign Application Priority Data

Jun. 20, 1997 (JP) ..... 9-164151

(51) Int. Cl.[7] ..... G09G 3/36
(52) U.S. Cl. ..... 345/97; 345/99; 345/103
(58) Field of Search ..... 345/97, 103, 87, 345/88, 89, 208, 99; 349/78

(56) References Cited

U.S. PATENT DOCUMENTS 4,857,906 A * 8/1989 Conner ..... 345/97
4,870,398 A * 9/1989 Bos ..... 345/97
5,233,338 A 8/1993 Surguy ..... 340/784
5,349,367 A * 9/1994 Wakita ..... 345/97
5,371,618 A * 12/1994 Tai et al. ..... 349/78
5,404,235 A * 4/1995 Okada ..... 345/87
6,052,106 A * 4/2000 Maltese ..... 345/97
6,078,303 A * 6/2000 McKnight ..... 345/208

FOREIGN PATENT DOCUMENTS

JP 4-366888 12/1992
JP 5-80717 4/1993
JP 5-265403 10/1993

* cited by examiner

*Primary Examiner*—Steven Saras
*Assistant Examiner*—Uchendu O. Anyaso
(74) *Attorney, Agent, or Firm*—Finnegan, Henderson, Farabow, Garrett & Dunner, L.L.P.

(57) ABSTRACT

A ferroelectric liquid crystal display comprises: a ferroelectric liquid crystal display element which includes a ferroelectric liquid crystal that is sandwiched between a pair of substrates having a plurality of scanning electrodes and signal electrodes deposited respectively on the opposing surfaces thereof; and a light source which successively emits a plurality of different colors of light. In the thus constructed ferroelectric liquid crystal display, a scanning period (TS) during which the light source emits light of one of the plurality of colors is divided into two periods, of which the first period (SC1) includes a selection period for determining a display state and a non-selection period for holding therethrough the display state selected during the selection period, and the second period (SC2), constituting the remainder of the scanning period, includes a selection period for forcing the display state into a black display state and a non-selection period for holding therethrough the black display state selected during the selection period.

11 Claims, 15 Drawing Sheets

FERROELECTRIC LIQUID CRYSTAL DISPLAY AND METHOD OF DRIVING THE SAME

TECHNICAL FIELD

The present invention relates to a ferroelectric liquid crystal display that uses a light source capable. of emitting a plurality of colors, in combination with a liquid crystal display panel, a liquid crystal optical shutter array, or a similar component, comprising a matrix of pixels having a liquid crystal layer formed from ferroelectric liquid crystals. The invention also relates to a method of driving such a ferroelectric liquid crystal display.

BACKGROUND ART

In the prior art, various methods have been proposed for accomplishing color display utilizing a successive additive color mixing phenomenon by using a liquid crystal cell as a shutter and by placing a light emitting device (such as an LED or CRT) behind the shutter. Prior art literature relating to such methods includes, for example, 7–9 "4 A Full-Color Field-Sequential Color Display" presented by Philip Bos, Thomas Buzak, Rolf Vatne et al. at Eurodisplay '84 (1984/9/18–20). Unlike methods that use color filters with the respective color segments provided at each pixel position, this display method produces color display by projecting differently colored lights in rapid succession. For the liquid crystal cell used with this method, the same structure as that of a cell used for monochrome display can be used. The light emitting device disposed behind the liquid crystal cell emits light of three primary colors, for example, R (red), G (green), and B (blue), which are successively projected onto the liquid crystal cell, each color for a predetermined duration of time (TS). That is, light of each color is projected onto the liquid crystal cell for the duration of time TS, in the order of R (red), G (green), and B (blue). These three primary colored lights are successively and repeatedly projected. The liquid crystal cell is controlled in synchronism with the time TS to vary the light transmittance of each display pixel. More specifically, the light transmittance for each of R, G, and B is determined by driving the liquid crystal cell in accordance with display color information. As an example, the light transmittance of the liquid crystal cell is set and held at 50% when R is being emitted for time TS, at 70% when G is being emitted for time TS, and at 90% when B is being emitted for time TS. Since the time TS is usually very short, the human eye does not perceive the respective colors as individually separate colors but as one color produced by mixing the respective colors.

Techniques utilizing such a method for ferroelectric liquid crystal display devices are disclosed in Japanese Patent Unexamined Publication Nos. 63-85523, 63-85524, and 63-85525.

DISCLOSURE OF THE INVENTION

In driving ferroelectric liquid crystals for color display utilizing the successive additive color mixing phenomenon, the time during which the light emitting device mounted as a light source behind the liquid crystal shutter emits light of one particular color is defined as TS, as described above. In order that changes in the color of light emitted from the light emitting device will not be perceived as flicker by the human eye when the R, G, and B colored lights are sequentially emitted from the light emitting device, the time TS must be made shorter than about 20 ms.

According to the conventional art ferroelectric liquid crystal driving method, the amount of light transmitted through a pixel during the time TS varies depending on which scan line the pixel is located. Consider, for example, a case where the entire liquid crystal display screen is displayed in white. In this case, since the color to be displayed is white, the liquid crystal is driven so that the light transmittance for each of R, G, and B becomes 100% for all pixels. During the time TS that R is being emitted, for example, a drive voltage is applied to the respective scanning electrodes. G is emitted for the next duration of time TS, followed by the emission of B for the duration of time TS, and the liquid crystal is driven accordingly for the respective durations of time TS to produce the desired color (in this case, white) for display. However, since the timing at which the selection voltage described later is applied to the selected scanning electrode becomes slightly displaced from one scanning elelectrode to the next, the length of time that the pixels on the scanning electrodes,X1, X2, . . . , Xn transmit the light of R during the time TS that the light of R is being emitted, becomes gradually shorter as the scanning progresses from top to bottom and, at the bottom most scanning electrode, pixels transmit the light of R only for a short period of time. If the length of time that a pixel transmits light, that is the amount of transmitted light, differs depending on the position of the scanning electrode associated with that pixel, the entire screen cannot be displayed with uniform brightness, nor can the color be controlled, rendering it impossible to display the desired color. For example, since the pixels on the bottommost scanning electrode transmit the light of R only for a short period of time, the amount of light of R decreases and a color different from white is displayed.

The present invention is aimed at resolving the above-described problem, and provides a ferroelectric liquid crystal display and a method of driving the same using the successive additive color mixing phenomenon for color display which can display the entire screen with uniform brightness and can achieve the display of the desired color.

According to the present invention, there is provided a ferroelectric liquid crystal display comprising: a ferroelectric liquid crystal display element which includes a ferroelectric liquid crystal that is sandwiched between a pair of substrates having a plurality of scanning electrodes and signal electrodes deposited respectively on the opposing surfaces thereof; and a light source which successively emits a plurality of different colors of light, wherein a scanning period (TS) during which the light source emits light of one of (the plurality of colors is divided into two periods, of which the first period (SC1) includes a selection period, for determining a display state and a non-selection period for holding therethrough the display state selected during the selection period, and the second period (SC2), constituting the remainder of the scanning period, includes a selection period for forcing the display state into a black display state and a non-selection period for holding therethrough the black display state selected during the selection period.

According to the present invention, there is also provided a ferroelectric liquid crystal display comprising: a ferroelectric liquid crystal display element which includes a ferroelectric liquid crystal that is sandwiched between a pair of substrates having N scanning electrodes and M signal electrodes deposited respectively on the opposing surfaces thereof; and a light source which successively emits a plurality of different colors, wherein a period (TS) during which the light source emits light of one of the plurality of colors is made up of an even number of scanning periods, wherein, in an odd-numbered scanning period, forward scanning is performed by scanning the scanning electrodes forward, starting at the first scanning electrode and progressing toward the N-th scanning electrode and, in an even-numbered scanning period, backward scanning is performed by scanning the scanning electrodes backward, starting at the N-th scanning electrode and progressing toward the first scanning electrode. The forward scanning and the backward scanning may be interchanged.

In a preferred embodiment of the ferroelectric liquid crystal display of the present invention, in a period (TS) during which the light source emits light of one of the plurality of colors, forward scanning is performed by scanning the scanning electrodes forward, starting at the first scanning electrode and progressing toward the N-th scanning electrode, and in a period (TS) during which the light source emits light of the same color the next time, backward scanning is performed by scanning the scanning electrodes backward, starting at the N-th scanning electrode and progressing toward the first scanning electrode, wherein the forward scanning and the backward scanning are repeated alternately.

ADVANTAGEOUS EFFECT OF THE INVENTION

According to the ferroelectric liquid crystal display of the present invention and its driving method, a uniform display can be produced with the entire display screen free from nonuniformity in brightness. Furthermore, the desired color can be displayed since the color can be controlled accurately.

DETAILED DESCRIPTION OF THE INVENTION

Figure 1:
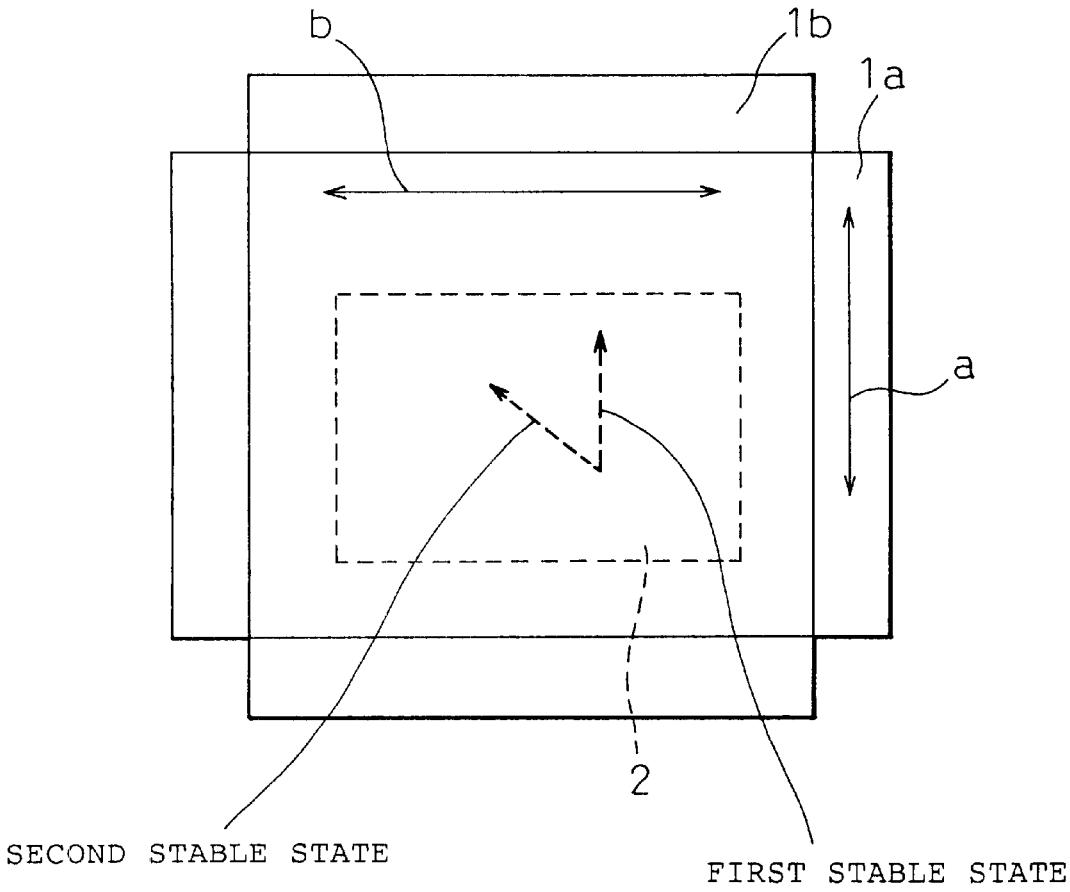
FIG. 1 is a diagram showing the arrangement of a ferroelectric liquid crystal cell and polarizers.

FIG. 1 is a diagram showing the arrangement of polarizers when a ferroelectric liquid crystal is used as a liquid crystal display element. Between the polarizers 1*a* and 1*b* arranged in a crossed Nicol configuration is placed a liquid crystal cell 2 in such a manner that the long axis direction of liquid crystal molecules when the cell is in a first stable state or in a second stable state is substantially parallel to either the polarization axis, a, of the polarizer 1*a* or the polarization axis, b, of the polarizer 1*b*.

Figure 2:
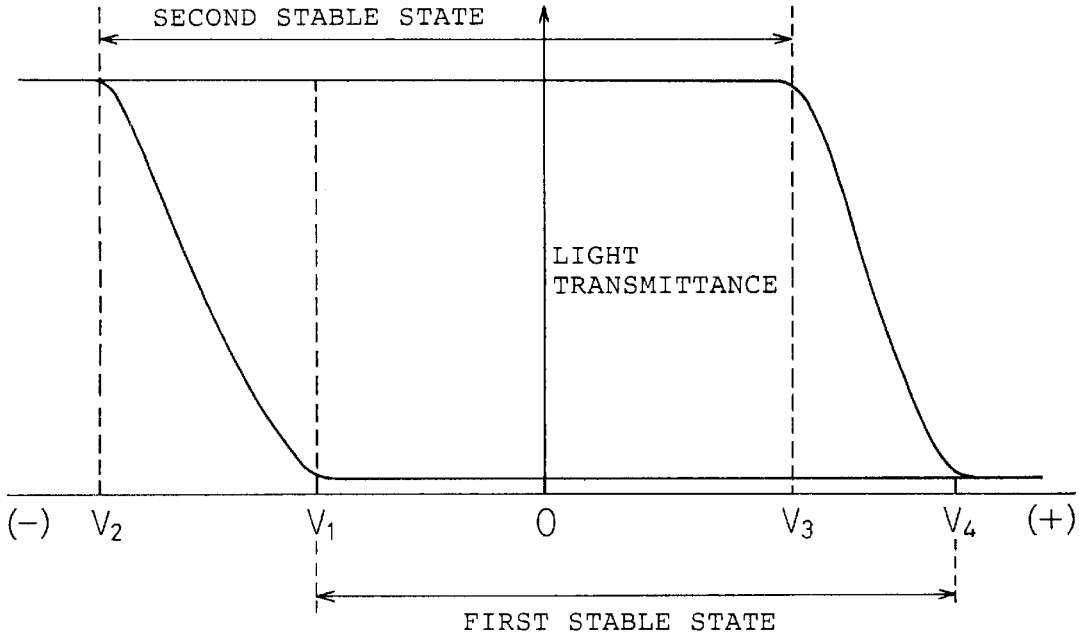
FIG. 2 is a diagram showing how the light transmittance of a ferroelectric liquid crystal display element varies with an applied voltage.

When voltage is applied across the thus structured liquid crystal cell, its light transmittance varies with the applied voltage, describing a loop as plotted in the graph of FIG. 2. The voltage value at which the light transmittance begins to change when the applied voltage is decreased is denoted by V1, and the voltage value at which the light transmittance reaches saturation is denoted by V2; on the other hand, the voltage value at which the light transmittance begins to drop when the applied voltage is increased into the region of the opposite polarity is denoted by V3, and the voltage value at and beyond which the light transmittance does not drop further is denoted by V4. As shown in FIG. 2, the first stable state is selected when the value of the applied voltage is greater than the threshold of the ferroelectric liquid crystal molecules. When a voltage of the opposite polarity greater than the threshold of the ferroelectric liquid crystal molecules is applied, the second stable state is selected.

When the polarizers are arranged as shown in FIG. 1, a black display (non-transmission state) can be produced in the first stable state and a white display (transmission state) in the second stable state. The arrangement of the polarizers can be changed so that a white display (transmission state) is produced in the first stable state and a black display (non-transmission state) in the second stable state. The description hereinafter given, however, assumes that the polarizers are arranged so as to produce a black display (non-transmission state) in the first stable state and a white display (transmission state) in the second stable state.

Figure 3:
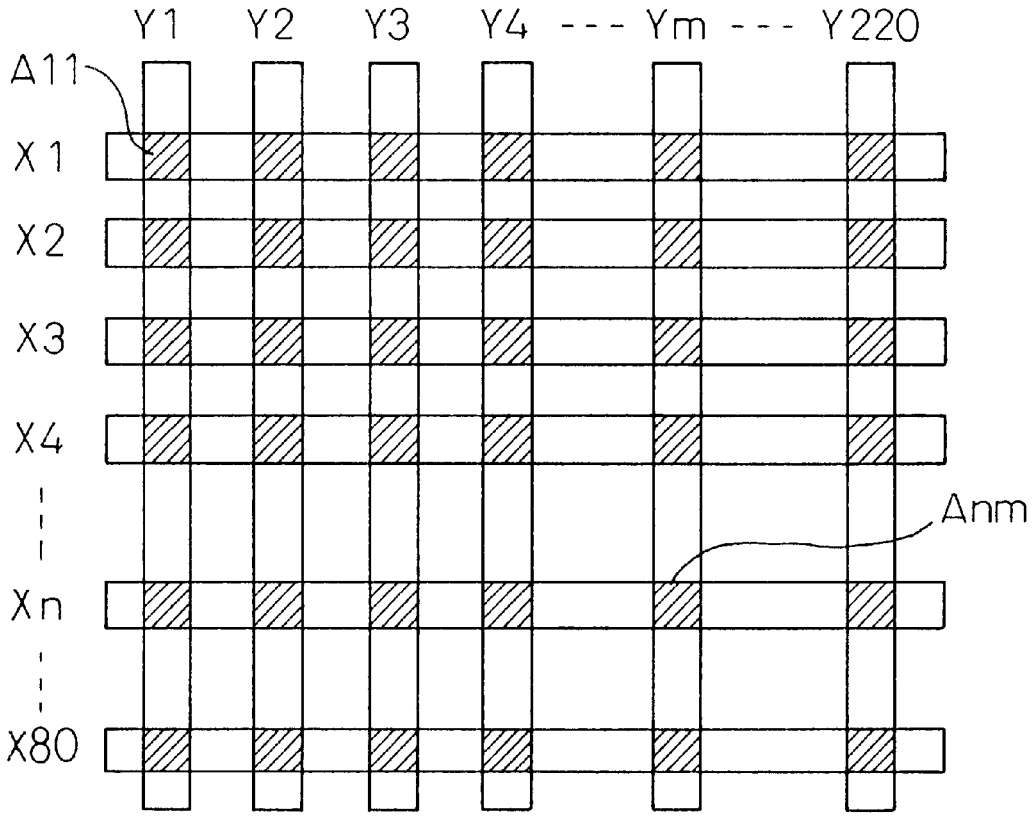
FIG. 3 is a diagram showing scanning electrodes and signal electrodes formed in a matrix array.

Next, a conventional liquid crystal driving method for a ferroelectric liquid crystal will be described. FIG. 3 is a diagram showing an example of an electrode arrangement in a liquid crystal panel having scanning electrodes and signal electrodes arranged in a matrix form on substrates. This electrode arrangement consists of the scanning electrodes (X1, X2, X3, . . . , Xn, . . . X80) and signal electrodes (Y1, Y2, Y3, . . . , Ym, . . . , Y220), and shaded portions where the scanning electrodes and signal electrodes intersect are pixels (All, Anm). Voltage is applied to the scanning electrodes, in sequence, one scanning line at a time, in synchronism with which voltage waveforms corresponding to the display states of the associated pixels are applied from the signal electrodes, and the display state of each pixel is written in accordance with a composite waveform produced by compositing the voltage waveforms applied to the associated signal electrode and the selected scanning electrode.

Figure 4:
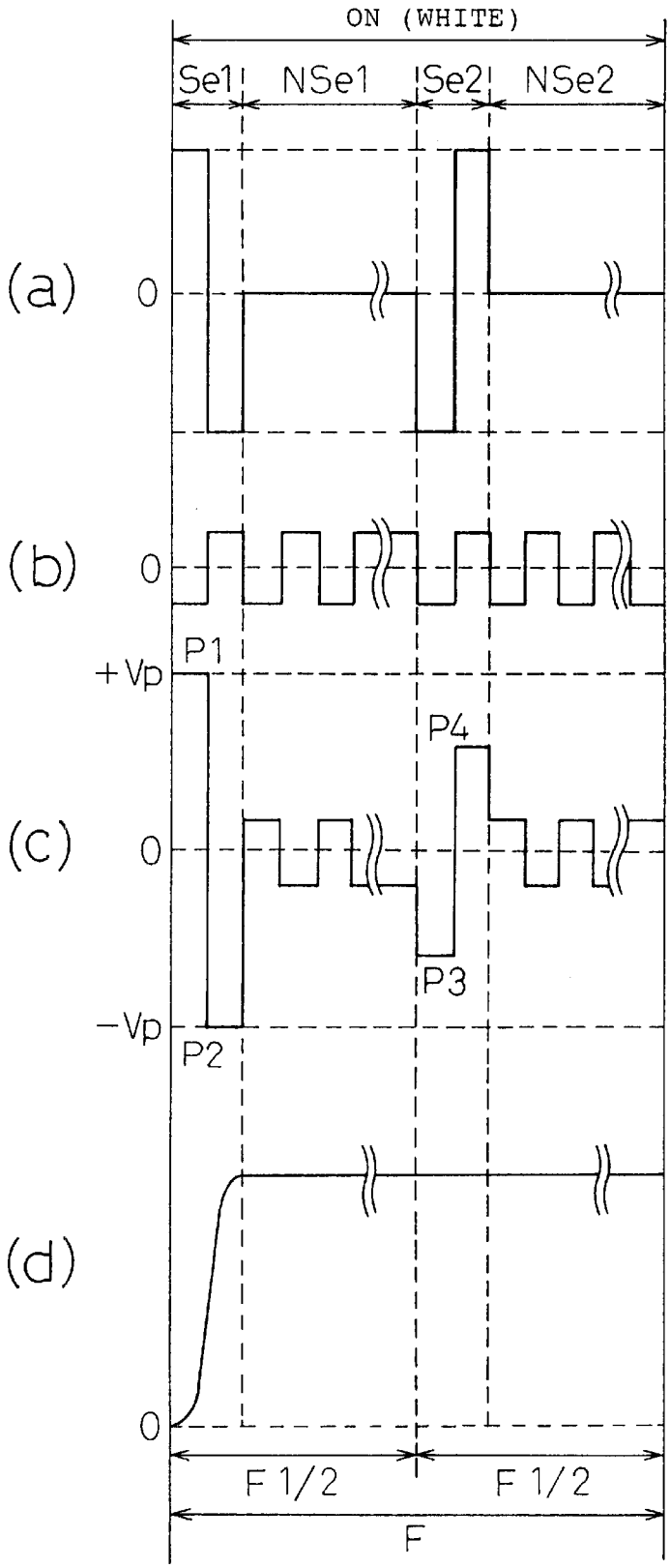
FIG. 4 is a diagram showing voltage waveforms applied to a scanning electrode, signal electrode, and pixel, and their corresponding light transmission amount (light transmittance) when producing a white display according to a conventional art driving method.

FIG. 4 shows examples of conventional drive voltage waveforms when driving the ferroelectric liquid crystal display in a white display mode. As shown in FIG. 4, writing to the pixel is accomplished by applying a scanning voltage (a) to the scanning electrode (Xn) and a signal voltage (b) to the signal electrode (Ym) and thereby applying the resulting composite voltage (c) to the pixel (Anm). Waveform (d) represents the light transmittance.

When attention is paid to the composite voltage (c), it will be noted that there are two selection periods within one frame. During the first selection period (Se1) in one frame (F), a pulse P1 having a pulse width T and a peak value +Vp greater than a threshold and a pulse P2 having a pulse width T and a peak value −Vp greater than a threshold are applied to the liquid crystal pixel. If it is assumed that the first pulse P1 is in the direction that switches the liquid crystal molecules from the second stable state (white display state) to the first stable state (black display state), then the second pulse P2 which is opposite in polarity accomplishes switching in the reverse direction, i.e., from the first stable state to the second stable state. Accordingly, the state achieved by the pulse P1 is not retained, but the second stable state achieved by the pulse P2 is retained. In the second stable state achieved by the pulse P2, the light transmittance rapidly rises to create a white display. In the first non-selection period (Nse1) that follows, since the amplitude of the applied pulse is below the threshold, the previously obtained second stable state is retained and the light transmittance is maintained at the previously achieved level.

Figure 5:
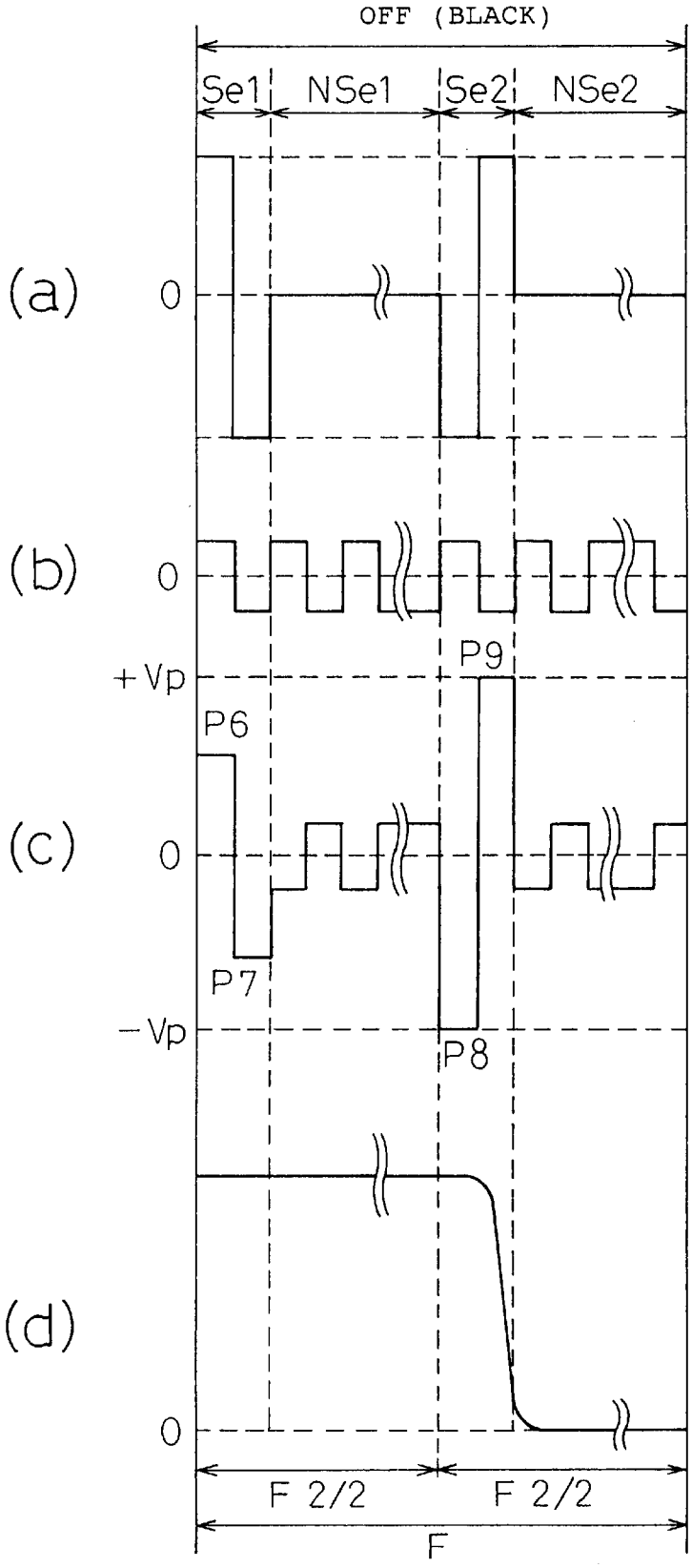
FIG. 5 is a diagram showing voltage waveforms applied to the scanning electrode, signal electrode, and pixel, and their corresponding light transmission amount (light transmittance) when producing a black display according to the prior art driving method.

FIG. 5 shows examples of conventional drive voltage waveforms when driving the ferroelectric liquid crystal display in a black display mode. When attention is paid to the composite waveform (c), since the peak values of the pulses P6 and P7 applied in the first selection period (Se1) in one frame (F) are both below the respective threshold values, the previously obtained second stable state is retained and the light transmittance is maintained at the previously achieved level throughout that period. Next, in the second selection period (Se2), since the peak values of the applied pulses P8 and P9 are −Vp and +Vp which are greater than the respective threshold values, switching from the second stable state to the first stable state is accomplished by the latter pulse P9, and the light transmittance drops, resulting in the creation of a black display.

When driving the liquid crystal for color display utilizing the successive additive color mixing phenomenon, the time during which the light emitting device mounted as a light source behind the liquid crystal shutter emits light of one particular color is defined as TS, as previously described. In this case, if the time TS is made shorter than about 20 ms, changes in the color of light being emitted from the light emitting device will not be perceived as flicker by the human eye when the R, G, and B colored lights are sequentially emitted from the light emitting device.

Figure 6:
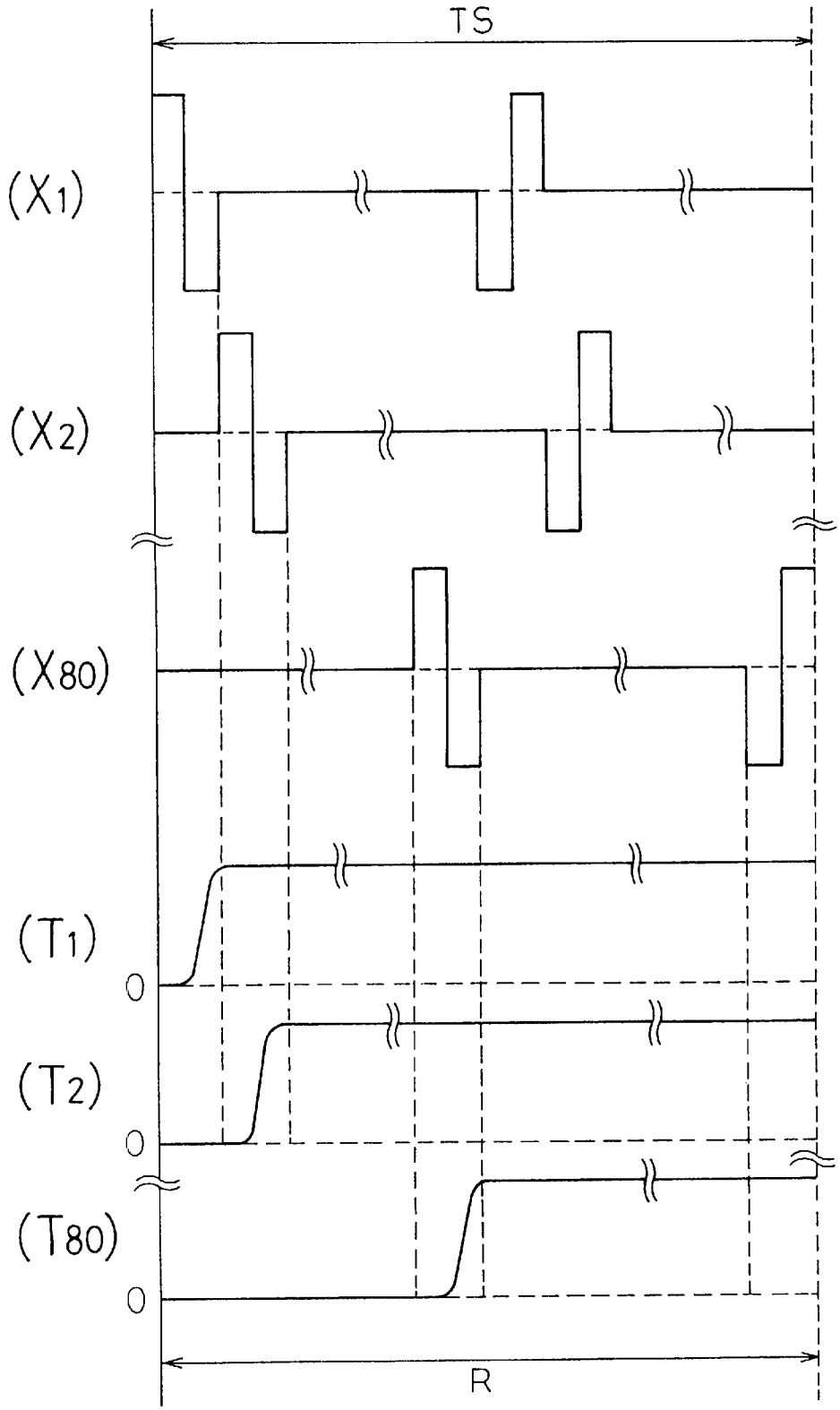
FIG. 6 is a diagram showing voltage waveforms applied to a plurality of scanning electrodes and their corresponding light transmission amounts (light transmittance), according to the conventional art driving method.

When the liquid crystal is driven to produce a color display utilizing the successive additive color mixing phenomenon by employing the conventional art ferroelectric liquid crystal driving method, the amount of light transmitted through a pixel during the time TS varies depending on which scan line the pixel is located, as previously described. Consider, for example, a case where the entire liquid crystal display screen is displayed in white. In this case, since the color to be displayed is white, the liquid crystal is driven so that the light transmittance for each of R, G, and B becomes 100% for all pixels. FIG. 6 shows the voltage waveforms applied to the respective scanning electrodes during the time TS that, for example, R is being emitted. G is emitted for the next duration of time TS, followed by the emission of B for the duration of time TS, and the liquid crystal is driven accordingly for the respective durations of time TS to produce the desired color (in this case, white) for display. The waveforms shown in FIG. 6 are the same as the driving waveforms applied to the scanning electrodes during the one frame period (F) for white display shown in FIG. 4. (X1), (X2), . . . , (X80) are the waveforms applied to the scanning electrodes X1, X2, . . . , X80, respectively, and (T1), (T2), . . . , (T80) are the waveforms showing how the light transmittance changes for the pixels associated with the respective scanning electrodes X1, X2, . . . , X80. Of the waveforms shown in FIG. 4, FIG. 6 shows only the scanning voltage waveform (a) and light transmittance waveform (d), and the signal voltage waveform (b) and composite voltage waveform (c) are omitted. As can be seen from FIG. 6, the length of time that the pixels on the scanning electrodes X1, X2, . . . , X80 transmit the light of R during the time that the light of R is being emitted, becomes gradually shorter as the scanning progresses from top to bottom and, at (T80), the length of time that the light is transmitted is about one half of that in (T1). If the length of time that the liquid crystal cell transmits light differs depending on the position of its associated scanning electrode, the color cannot be controlled and the desired color cannot be displayed. For example, in the case of FIG. 6, since the pixels on X80 transmit the light of R for a shorter period of time than the pixels on other scanning electrodes, the amount of transmitted light correspondingly decreases, reducing the pixel brightness. As a result, the entire screen cannot be displayed with uniform brightness, and a color different from white is displayed.

Figure 7:
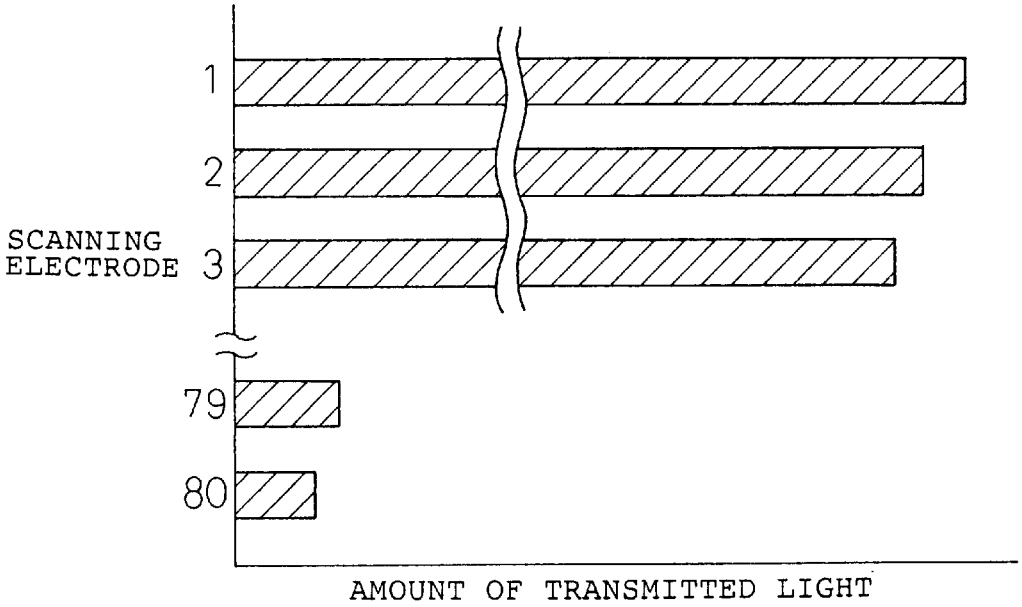
FIG. 7 is a graph showing the amounts of light transmitted through the pixels on the respective scanning electrodes when a white display was produced by the conventional art driving method.

FIG. 7 is a graph where the vertical axis represents the scanning electrode location and the horizontal axis represents the amount of transmitted light (the length of light transmission time) for pixels on the respective scanning electrodes when producing a white display. As can be seen from the graph, the amount of light transmitted through the pixel decreases in increasing order of the scanning electrode location 1, 2, 3, . . . , 79, and 80. Thus, according to the conventional ferroelectric liquid crystal driving method shown in FIG. 4, the amount of light transmitted by a pixel varies depending on the location of the scanning electrode associated with that pixel. Therefore, if the conventional art driving method is employed for a liquid crystal display device that utilizes the successive additive color mixing phenomenon, since the amount of transmitted light varies from one scanning line to the next, the color cannot be controlled accurately, especially when the number of scanning electrodes is large, rendering it impossible to produce a good display by maintaining uniform brightness over the entire screen.

The present invention is aimed at resolving the above-described problem, and provides a ferroelectric liquid crystal display, and a.method of driving the same, that uses the successive additive color mixing phenomenon for color display and that can display the entire screen with uniform brightness and can achieve the display of the desired color.

Embodiment 1

Figure 8:
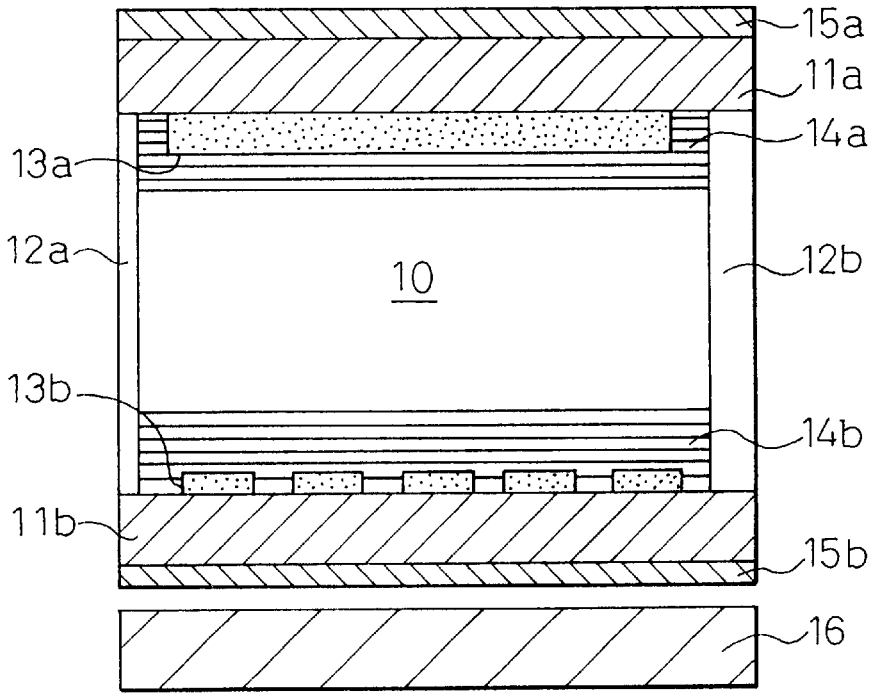
FIG. 8 is a diagram showing the structure of a liquid crystal display used in the embodiments of the present invention.

Embodiments of the present invention will be described in detail below with reference to drawings. FIG. 8 is a diagram showing the structure of a liquid crystal panel used in the embodiments of the present invention. The liquid crystal panel used in the embodiments comprises: a pair of glass substrates 11*a* and 11*b* between which a ferroelectric liquid crystal layer 10 with a thickness of about 2 μm is sandwiched; and sealing members 12*a* and 12*b* for bonding the two glass substrates together. On the opposing surfaces of the glass substrates 11*a* and 11*b* are formed electrodes 13*a* and 13*b*, which are coated with polymeric alignment films 14*a* and 14*b*, respectively, and are treated with rubbing. On the outside surface of one glass substrate is disposed a first polarizer 15*a* with its polarization axis oriented parallel to the long axis of ferroelectric liquid crystal molecules in the first or second stable state, while on the outside surface of the other glass substrate, a second polarizer 15*b* is arranged with its polarization axis oriented at 90° to the polarization axis of the first polarizer 15*a*. An LED, as a backlight 16, that emits three colored lights (R, G, and B) is mounted behind the thus structured liquid crystal device. The backlight 16 is operated to emit light of R, G, and B in this order, each color for a duration of about 16.7 ms.

The electrode arrangement in the liquid crystal panel is the same as that shown in FIG. 3, and the scanning electrodes and signal electrodes are arranged as shown in FIG. 3. X1, X2, . . . , Xn are the scanning electrodes, and Y1, Y2, . . . , Ym are the signal electrodes Shaded portions where the scanning electrodes and signal electrodes intersect are pixels (All, Anm). In the electrode arrangement shown in FIG. 3, there are 80 scanning electrodes and 220 signal electrodes, but their numbers can be changed arbitrarily.

Figure 9:
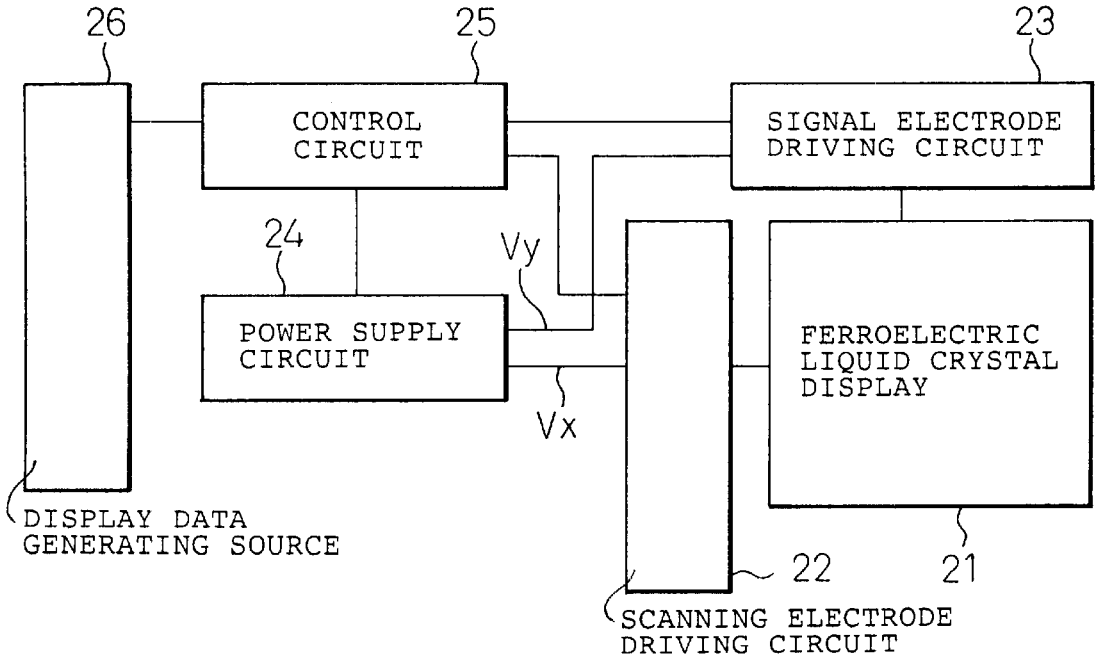
FIG. 9 is a block diagram showing a driving circuit configuration for the ferroelectric liquid crystal display of the present invention.

FIG. 9 is a block diagram showing a driving circuit configuration for the ferroelectric liquid crystal display. In the ferroelectric liquid crystal display 21 shown in the figure, the scanning electrodes to which scanning signals are applied are connected to a scanning electrode driving circuit 22, and the signal electrodes to which display signals are applied are connected to a signal electrode driving circuit 23. A power supply circuit 24 supplies the scanning electrode driving circuit 22 with a voltage Vx necessary for driving the scanning electrodes of the liquid crystal display, and the signal electrode driving circuit 23 with a voltage Vy necessary for driving the signal electrodes of the liquid crystal display. A control circuit 25, based on a signal from a display data generating source 26, supplies signals to the scanning electrode driving circuit 22 and signal electrode driving circuit 23 which then supply signals, respectively consisting of the voltages Vx and Vy, to the liquid crystal display 21 in accordance with the respectively supplied signals.

Figure 10:
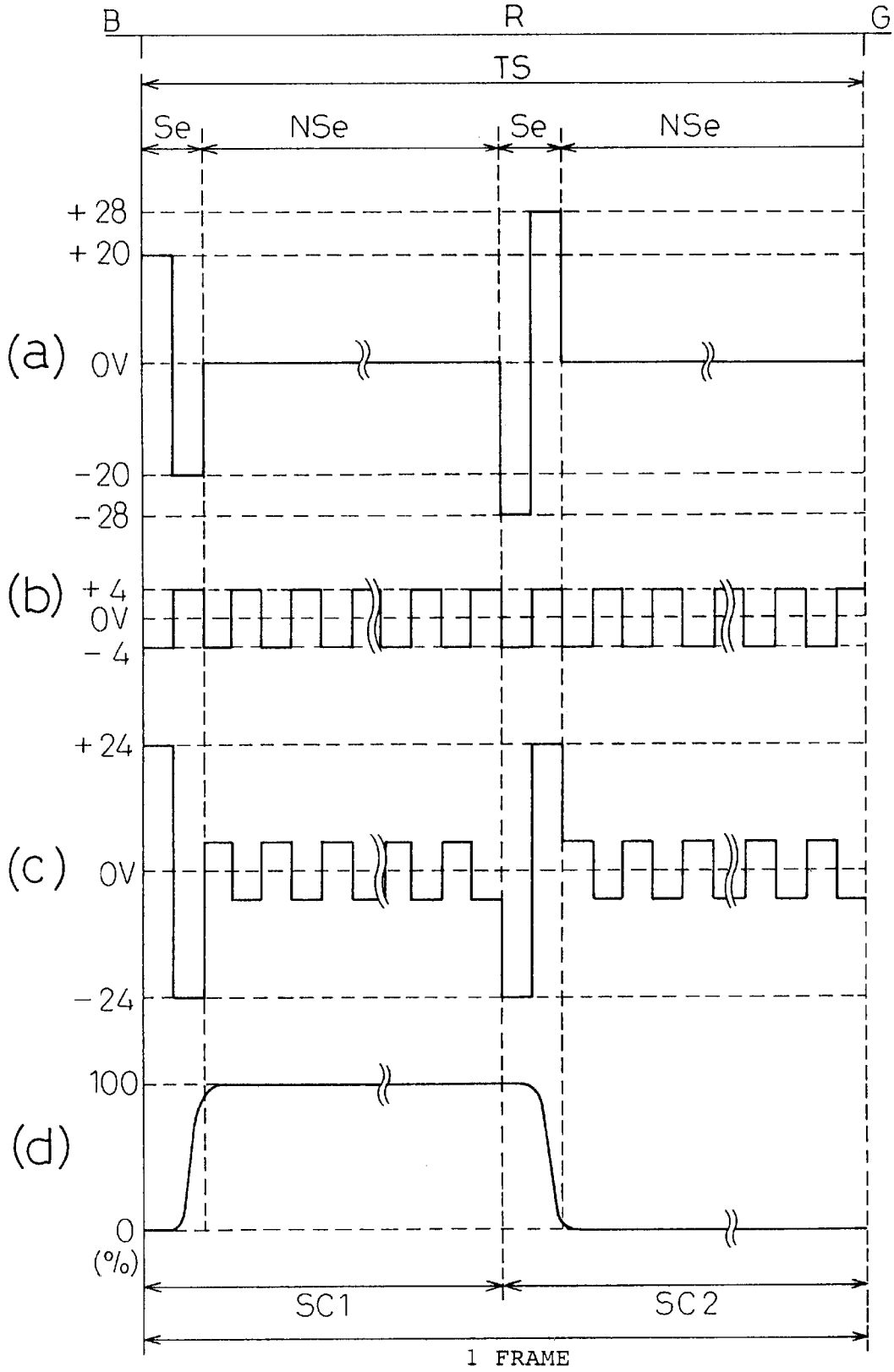
FIG. 10 is a diagram showing driving waveforms and the amount of transmitted light (light transmittance) in a first embodiment of the present invention.

FIG. 10 is a diagram showing a first embodiment of the present invention. The diagram of this embodiment shows a voltage waveform (a) applied to the scanning electrode (Xn), a voltage waveform (b) applied to the signal electrode (Ym), and a composite driving voltage waveform (c) applied to the pixel (Anm) located at their intersection, along with the corresponding change (d) in the amount of transmission (T) of light from the backlight, during the time TS when the ferroelectric liquid crystal display of the present invention is driven in white display mode. The liquid crystal driving waveforms used in the present invention represent the waveforms applied during the scanning period of time TS when light of one of the three primary colors, for example, R, is being emitted. The scanning period consists of two periods. The first period (SC1) is made up of a selection period and a non-selection period, the selection period (Se) consisting of two phases and the non-selection period (NSe) constituting the remainder of the first period. The second period (SC2) is likewise made up of a selection period and a non-selection period, the selection period (Se) consisting of two phases and the non-selection period (NSe) constituting the remainder of the second period. The pulse width of one phase is chosen to be about 70 μs. In the first period (SC1), a pulse of a voltage value of +20 V is applied to the scanning electrode (Xn) in the first phase of the selection period (Se) and a pulse of a voltage value of −20 V is applied to the same electrode in the second phase, while no voltage is applied during the non-selection period (NSe). In the second period (SC2), a pulse of a voltage value of −28 V is applied to the scanning electrode (Xn) in the first phase of the selection period (Se) and a pulse of a voltage value of +28 V is applied to the same electrode in the second phase, while no voltage is applied during the non-selection period (NSe). A voltage waveform of ±4 V is applied to the signal electrode (Ym), depending on the display state to be produced.

In the embodiment shown in FIG. 10, the driving voltage waveforms and the amount of transmitted light are shown when the ferroelectric liquid crystal display is driven in a white display mode. In this case, since the voltage of ±24 V (selection pulse) is applied as the composite voltage waveform (c) during the selection period (Se) in the first period (SC1), the ferroelectric liquid crystal is set in the seconds table state, and the amount of transmitted light (T) increases nearly to 100% in the selection period(Se). In the non-selection period (NSe), the ferroelectric liquid crystal retains the second stable state by its memory effect, and the light transmittance is thus maintained at 100%, maintaining the white display state. In the second period (SC2), the composite voltage waveform consisting of a voltage of −24 V in the first phase and a voltage of +24 V in the second phase is applied during the selection period (Se). As a result, the ferroelectric liquid crystal makes a transition from the second stable state to the first stable state, so that the amount of transmitted light decreases to 0% and the black display is thus produced. As shown in FIG. 10, the period during which the light, in this case, the light R, is transmitted 100% is the first period (SC1).

Figure 11:
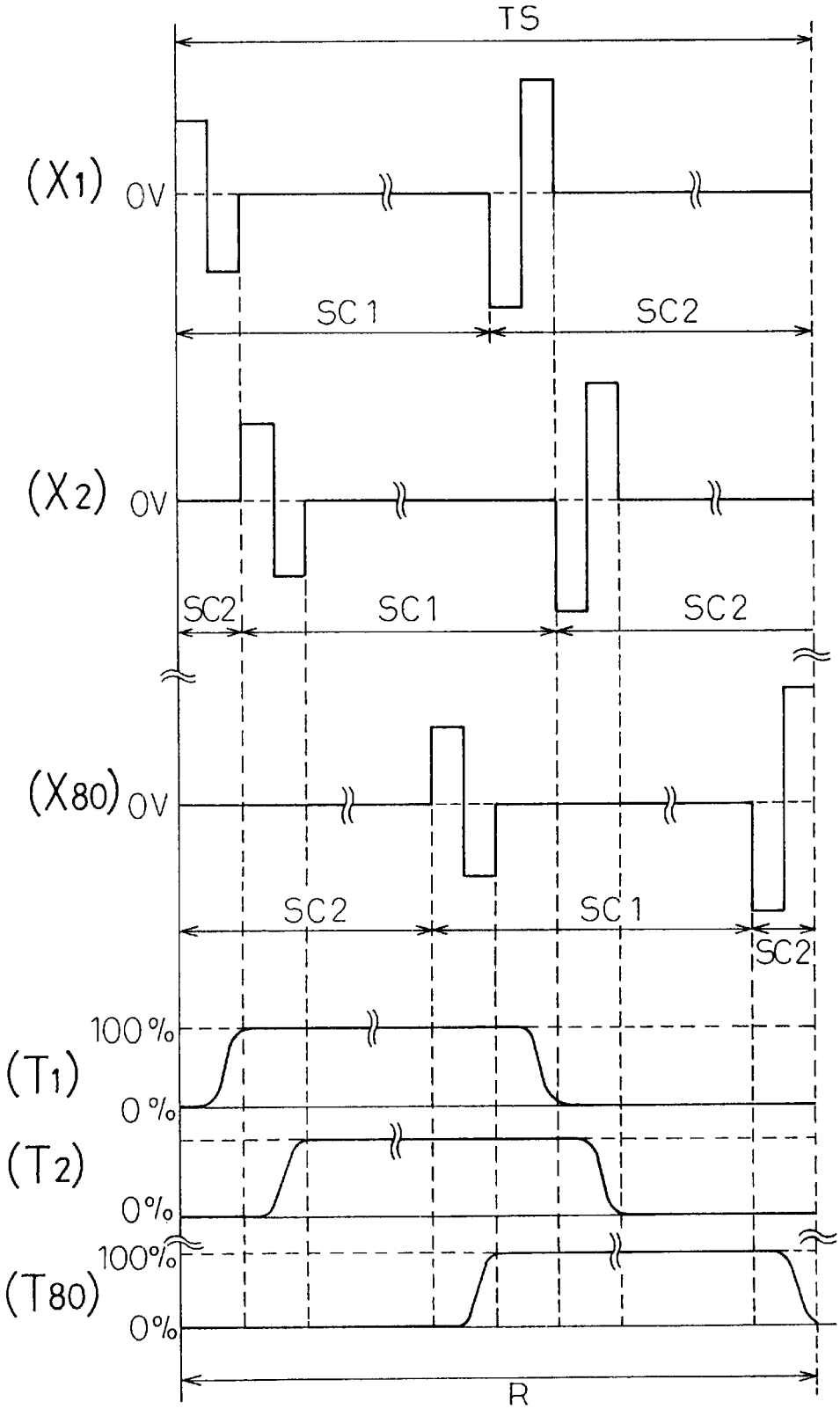
FIG. 11 is a graph showing the driving waveforms in further detail in relation to the amount of transmitted light (light transmittance) according to the first embodiment of the present invention.

While FIG. 10 showed the voltage waveform applied to one particular scanning electrode, FIG. 11 shows the voltage waveforms (X1), (X2), and (X80) applied to the first, second, and 80th scanning electrodes X1, X2, and X80 during the time TS that R is being emitted when the ferroelectric liquid crystal display of the present invention is driven in a white display mode, and also the waveforms (T1), (T2), and (T80) showing the changes in transmittance for the pixels on the respective scanning electrodes during the period TS. In the figure, each of the voltage waveforms applied to the scanning electrodes X1, X2, and X80 is the same as the voltage waveform (a) applied to the scanning electrode Xn in FIG. 10, and the voltage waveforms are displaced by 1/N from one scanning electrode to the next, where N is the number of scanning electrodes. These voltage waveforms (X1), (X2), and (X80) are each divided into the first period (SC1) and the second period (SC2), as in the case of FIG. 10. The voltage waveforms (X1) and (X80) applied to the scanning electrodes X1 and X80 are each divided at midpoint between the first and second periods. On the other hand, in the case of the voltage waveform (X2) for the scanning electrode X2, the first period SC1 is located somewhere near the middle, and the second period is located before and after that. As a result, though the position where the transmittance is at 100% is displaced along the time TS, the amount of light transmitted through the pixel becomes equal for all the scanning electrodes, as shown by the transmittance waveforms (T1), (T2), and (T80). FIG. 11 showed the transmittance waveforms (T1), (T2), and (T80) for the pixels associated with the scanning electrodes X1, X2, and X80, but it will be noted that the pixel transmittance waveforms for other scanning electrodes are approximately the same as those shown in FIG. 10, so that the amount of transmitted light is also the same for all other scanning electrodes.

As shown in FIG. 11, according to the driving method of the present invention, the period (SC2) during which the ferroelectric liquid crystal is forcefully set in the black display state is provided within the time TS during which the light emitting device emits light of one particular color. Accordingly, the first period (SC1) during which the light is transmitted is displaced by an amount equal to the selection period Se from one scanning line to the next, as shown in FIG. 11, and at the same time, the second period (black display period) during which the light is not transmitted is shifted accordingly for each scanning line. As a result, the length of the period during which the light is transmitted through the pixels is the same for all the scanning lines. In the present invention, the second period during which the ferroelectric liquid crystal is set in the black display state should only be provided somewhere within the period TS, but the best result can be obtained if the second period is set equal in length to one half of the period TS.

Figure 12:
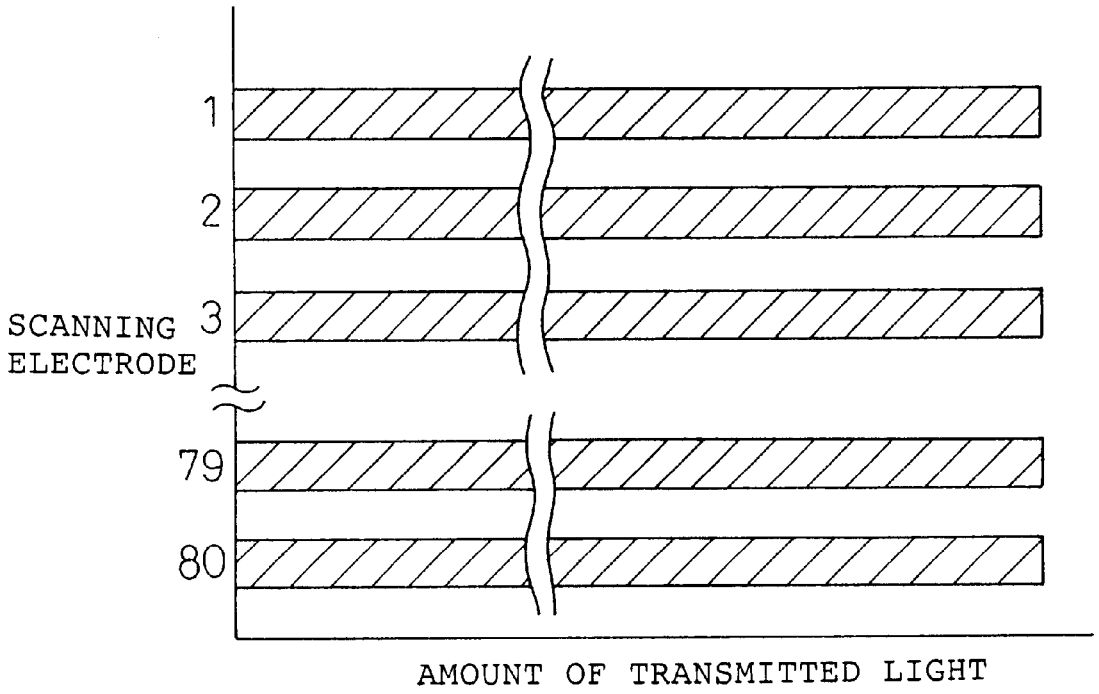
FIG. 12 is a graph showing the amounts of light transmitted through the pixels on the respective scanning electrodes when a white display was produced by the driving method according to the first embodiment of the present invention.

FIG. 12 is a graph showing the amounts of light transmitted through the pixels on the respective scanning electrodes when the liquid crystal driving method of the present invention is employed. In the graph of FIG. 12, the vertical axis represents the scanning electrode location and the horizontal axis the amount of light transmitted through the pixels on each scanning electrode during the time TS when the white display was produced. The time TS during which one backlight color was illuminated was chosen to be 16.7 ms. The length of time that the pixels transmitted light, was about 8.3 ms for each scanning electrode. The desired color display state and a uniform brightness display screen free from nonuniformity in brightness could thus be obtained.

Embodiment 2

In the first embodiment, driving waveforms different from the liquid crystal driving waveforms shown in FIG. 4 were used. However, the conventional art problem can also be solved by using the liquid crystal driving waveforms shown in FIG. 4 that were used in the conventional art.

Figure 13:
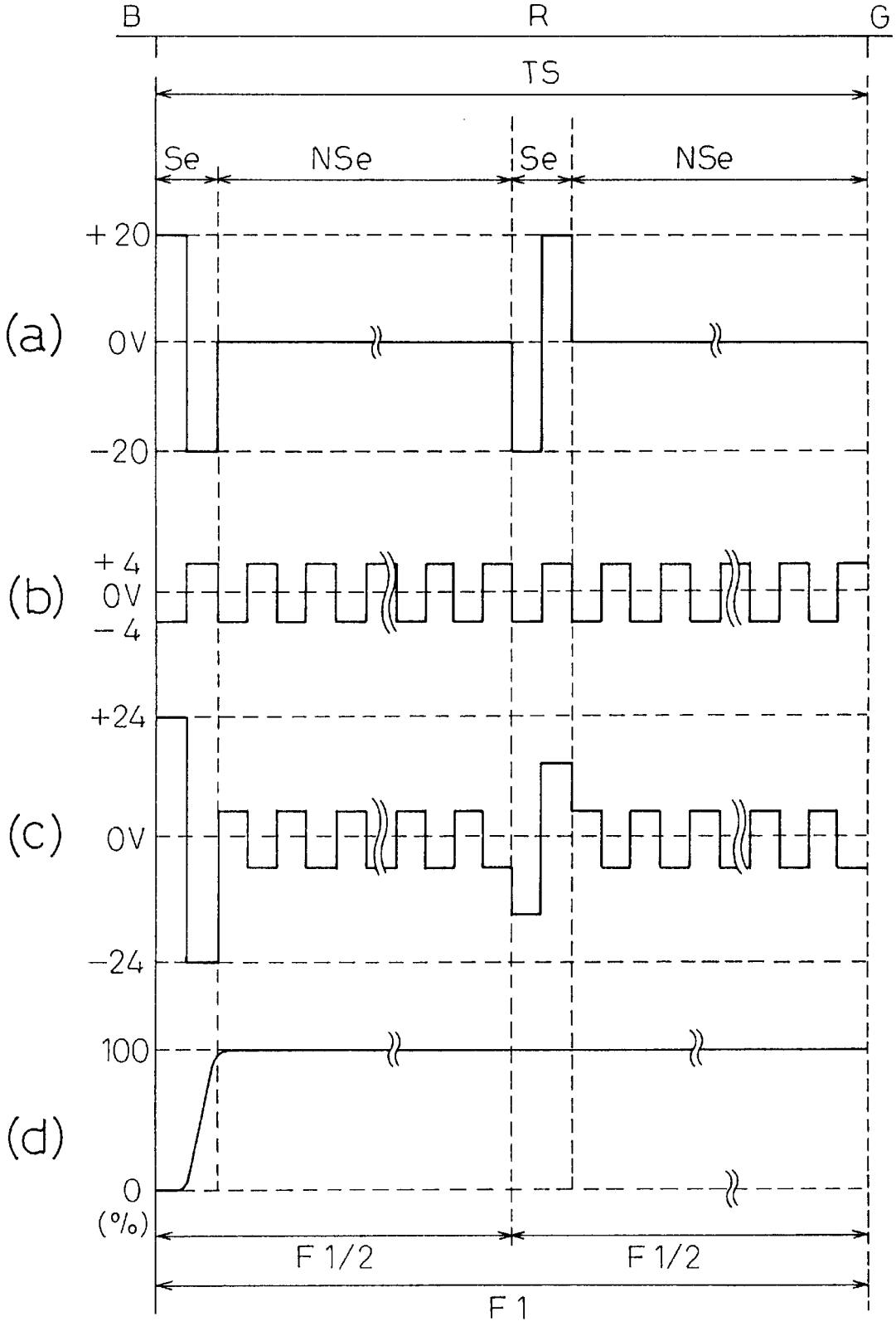
FIG. 13 is a diagram showing driving waveforms and the amount of transmitted light (light transmittance) in a second embodiment of the present invention.

FIG. 13 is a diagram showing the driving waveforms for one frame in FIG. 4. These driving waveforms are identical to the traditionally used waveforms, and the waveform applied to the scanning electrode is the same for the first half (F1/2) of the first frame as for the second half (F1/2) of the first frame, except that the polarity is reversed. In the figure, (a) is the voltage waveform applied to the scanning electrode (Xn), (b) is the voltage waveform applied to the signal electrode (Ym), and (c) is the composite voltage waveform applied to the pixel. The light transmittance of the liquid crystal varies with the voltage waveform applied to the pixel. The driving waveforms shown here are applicable when driving the screen in white display mode.

In the second embodiment of the present invention, the driving waveforms shown in FIG. 13 are applied to the liquid crystal, for example, twice, i.e., for two frames while light of one color (for example, R) is being emitted. In the scanning period of the first frame (F1), the voltage waveform (a) is applied in sequence to the scanning electrodes, starting at the first electrode and ending at the N-th electrode, the waveform being displaced by 1/N from one electrode to the next. In the second frame (F2), on the other hand, the voltage waveform (a) is applied in the reverse order, starting at the N-th electrode and ending at the first electrode, with a displacement of 1/N from one electrode to the next. Accordingly, in the first frame (F1), the amount of light transmitted through pixels decreases as the scanning progresses in the order of the scanning electrodes 1, 2, 3, and so on, as explained with reference to FIG. 7. Conversely, in the scanning period of the second frame (F2), the amount of light transmitted through pixels increases in the order of the scanning electrodes 1, 2, 3, and so on. Therefore, the amount of light transmitted through pixels, the first and second frames (F1 and F2) combined, becomes the same for all the scanning electrodes. This achieves a uniform brightness display screen free from nonuniformity in brightness. Furthermore, the desired color can be displayed since the color can be controlled accurately.

Figure 14:
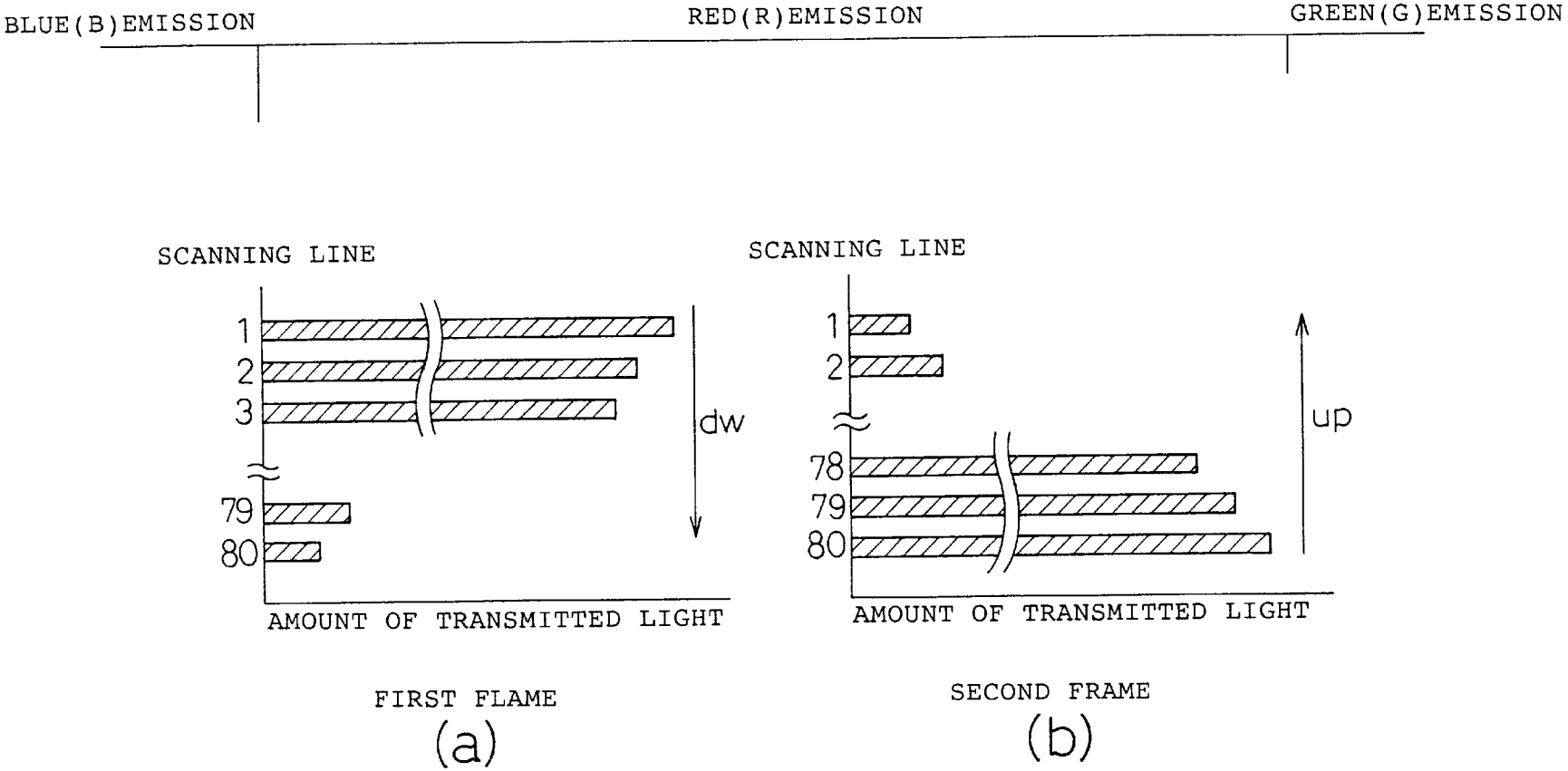
FIG. 14 is a graph showing the amounts of light transmitted through the pixels on the respective scanning electrodes when a white display was produced by the driving method according to the second embodiment of the present invention.

FIG. 14 shows graphs similar to those shown in FIG. 7 but redrawn for the first frame (F1) and the second frame (F2), respectively. The graphs show the case of 80 scanning electrodes. In the first frame, the driving voltage is applied in sequence, starting at the first scanning electrode and ending at the 80th scanning electrode, as shown by arrow dw, and in the second frame, the driving voltage is applied in sequence, starting at the 80th scanning electrode and ending at the first scanning electrode, as shown by arrow up. In the first frame, the amount of light transmitted through pixels decreases as the scanning progresses from the first to the 80th scanning electrode, as shown in FIG. 14. In the second frame, on the other hand, the amount of light transmitted through pixels increases in increasing order of scanning electrode number, i.e., from the first to the 80th scanning electrode. The color of light being emitted during the illustrated period is R, and the same driving waveform is applied during the next period of G emission.

In the second embodiment using the driving waveforms shown in FIG. 13, writing is performed two times during the emission of one color. However, the number of times the writing is performed need not be limited to two, but the writing can be performed an even number of times, such as two times, four times, or 2N times (N is a natural number), depending on the response speed of the liquid crystal.

In the above description, during the scanning period of the first frame (F1),that is, during an odd-numbered scanning period, the scanning voltage is applied in sequence, starting at the first scanning electrode and ending at the 80th scanning electrode, and during the scanning period of the second frame (F2), that is, during an even-numbered scanning period, the scanning voltage is applied in sequence, starting at the 80th scanning electrode and ending at the first scanning electrode. However, the order of the scanning voltage application may be reversed from that described above.

Embodiment 3

In the second embodiment, the driving voltage waveforms for a plurality of frames were applied during the period TS that one particular color was being emitted. However, the prior art problem can also be solved in another way by using the same driving waveforms as those shown in FIG. 13.

Figure 15:
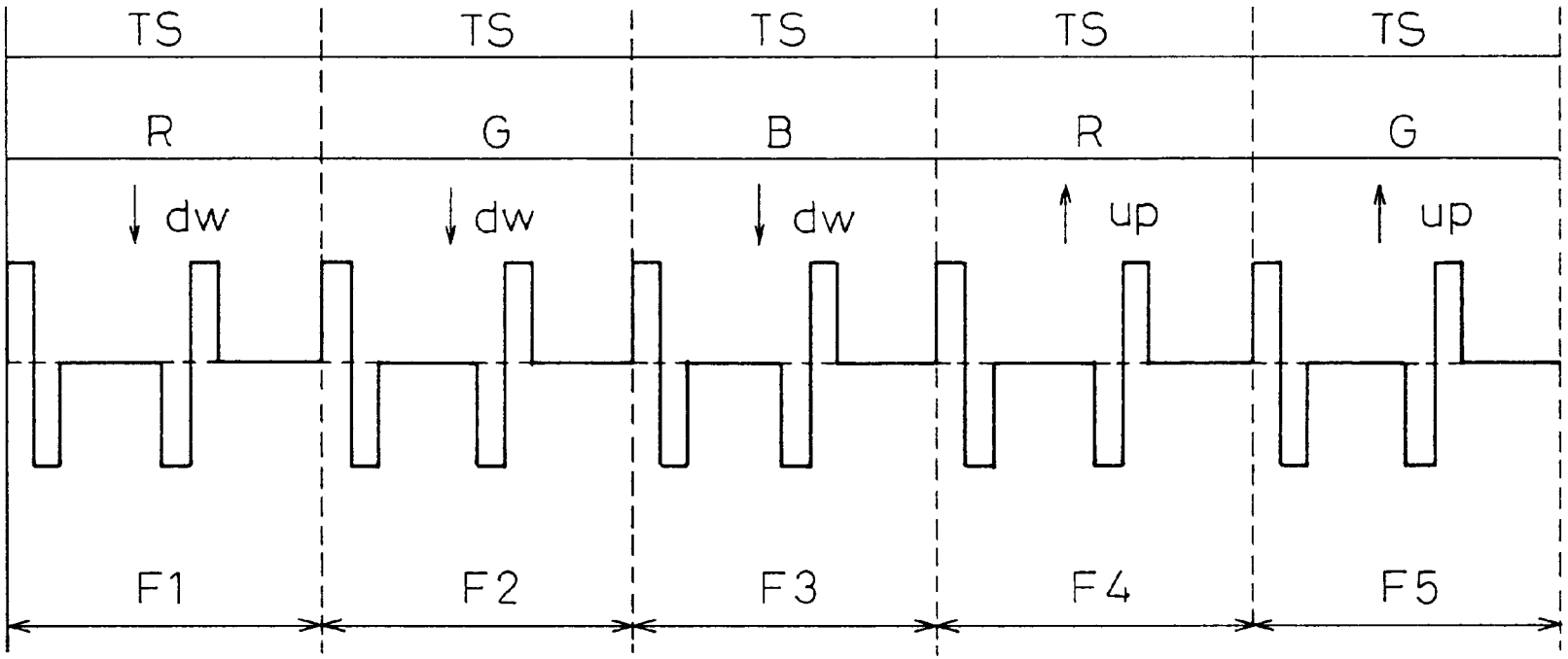
FIG. 15 is a diagram showing driving waveforms according to a third embodiment of the present invention.

FIG. 15 is a diagram illustrating a third embodiment of the present invention. FIG. 15 shows the scanning electrode driving voltage (a) for each frame and the color (R, G, or B) being emitted during the corresponding frame period. The waveform (b) applied to the signal electrode, the composite voltage waveform (c), and the transmittance waveform (d) shown in FIG. 13 are not shown here, but the same waveforms are also used here. In the third embodiment, each frame period is made substantially equal to the period TS during which light of one color is emitted, and R, G, and B are emitted in sequence in corresponding relationship with the frames F1, F2, and F3, respectively. When attention is paid to the frames F1 and F4 during which R is emitted, in F1 the driving voltage is applied in sequence, starting at the first scanning electrode and ending at the 80th scanning electrode, as shown by arrow dw, while in F4, the driving voltage is applied in sequence, starting at the 80th scanning electrode and ending at the first scanning electrode, as shown by arrow up.

Figure 16:
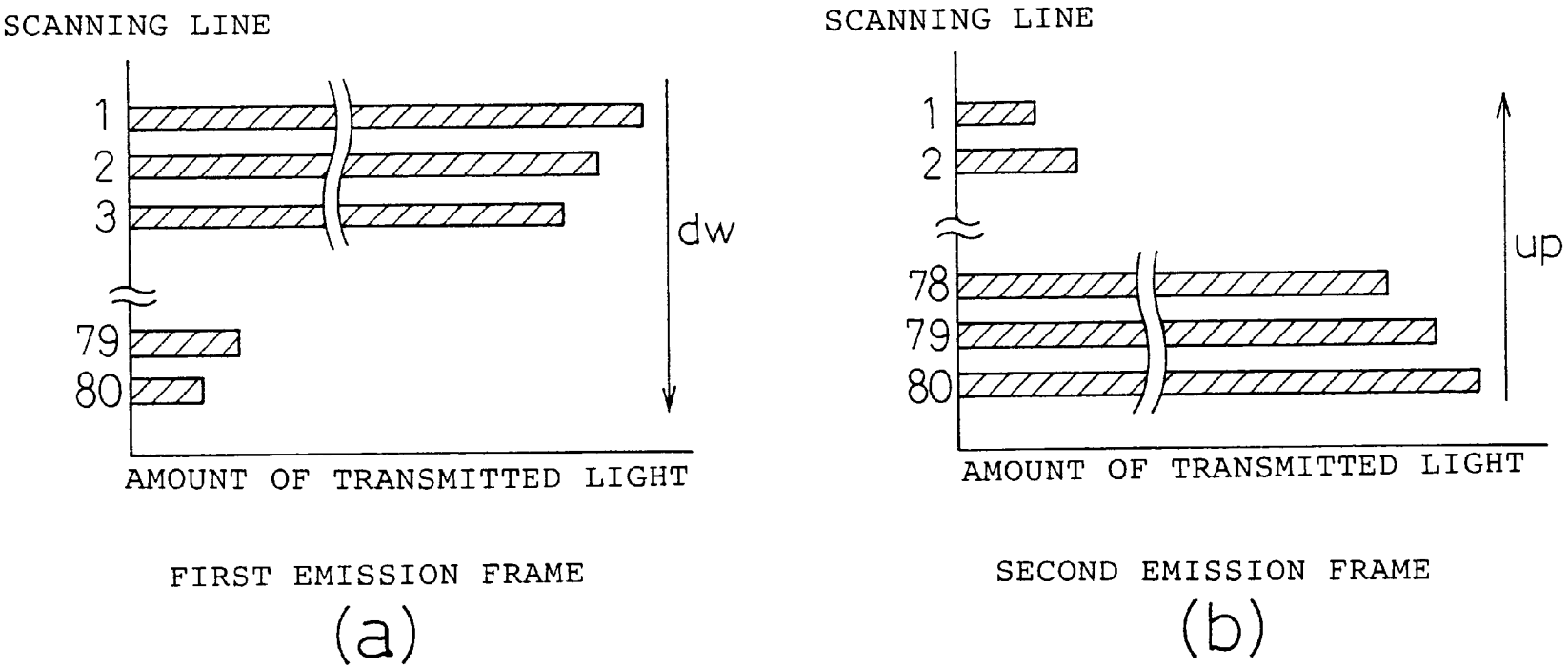
FIG. 16 is a graph showing the amounts of light transmitted through the pixels on the respective scanning electrodes when a white display was produced by the driving method according to the third embodiment of the present invention.

FIG. 16 is a diagram showing the amount of transmitted light when the driving voltage was applied as just described. In comparison, the graphs in FIG. 14 showed the amount of transmitted light when the driving voltage for two frames was applied to the scanning electrodes by reversing the order between the frames during the period that light of one particular color (for example, R) was being emitted. On the other hand, in the case of the graphs shown in FIG. 16, the driving voltage for one frame is applied during the period that light of one particular color (for example, R) is being emitted. It should, however, be noted that for the same color of light (for example, R), the order in which the driving voltage is applied to the scanning electrodes is reversed for the second emission frame from that for the first emission frame, as shown by arrows dw and up. Accordingly, the amount of light transmitted by pixels, in the first R emission frame (F1) and the second R emission frame (F4) combined, becomes the same for all the scanning electrodes, thus eliminating brightness nonuniformity from the display screen and enabling the desired color to be displayed.

What is claimed is:

1. A ferroelectric liquid crystal display comprising:

a ferroelectric liquid crystal display element which includes a ferroelectric liquid crystal that is sandwiched between a pair of substrates having at least one electrode deposited respectively on the opposing surfaces thereof; and a light source which sequentially emits R, G, and B colors of light, wherein a scanning period during which one of the R, G, and B colors of light is emitted is divided into first and second periods substantially equal in length, the first period including a selection period for determining a display state and a non-selection period for holding therethrough the display state determined during said selection period, and the second period, constituting the remainder of said scanning period, including a selection period for forcing said display state into a black display state and a non-selection period for holding therethrough the black display state selected during said selection period.

2. A ferroelectric liquid crystal display as claimed in claim 1, wherein said ferroelectric liquid crystal has a first stable state and a second stable state which is entered when a voltage of opposite polarity is applied, and wherein a voltage value of a composite voltage waveform produced by compositing a scanning voltage waveform and a signal voltage waveform applied during said selection period in said second period is equal to or greater than a threshold voltage value at which said ferroelectric liquid crystal makes a transition to said first or said second stable state.

3. A ferroelectric liquid crystal display as claimed in claim 1, wherein a signal voltage waveform applied during said second period is always set as a black display producing signal voltage waveform.

4. A ferroelectric liquid crystal display as claimed in any one of claims 1 to 3, wherein said first period is located somewhere near the middle of said scanning period.

5. A ferroelectric liquid crystal display comprising:

a ferroelectric liquid crystal display element which includes a ferroelectric liquid crystal that is sandwiched between a pair of substrates having N scanning electrodes and M signal electrodes deposited respectively on the opposing surfaces thereof; and a light source which sequentially emits R, G, and B colors of light, wherein a period during which one of the R, G, and B colors of light is emitted is divided into an even number of scanning periods, wherein, in an odd-numbered scanning period, one of forward scanning and backward scanning is performed and, in an even-numbered scanning period, the other of the forward scanning and the backward scanning is performed, and wherein the forward scanning is performed by scanning said scanning electrodes forward, starting at the first scanning electrode and progressing toward the N-th scanning electrode and the backward scanning is performed by scanning said scanning electrodes backward, starting at the N-th scanning electrode and progressing toward the first scanning electrode.

6. A ferroelectric liquid crystal display as claimed in claim 5, wherein in said odd-numbered scanning period, the forward scanning is performed and, in said even-numbered scanning period, the backward scanning is performed.

7. A method of driving a ferroelectric liquid crystal display, the ferroelectric liquid crystal display comprising a ferroelectric liquid crystal display element and a light source which sequentially emits R, G, and B colors of light, the ferroelectric liquid crystal display element including a ferroelectric liquid crystal that is sandwiched between a pair of substrates having at least one electrode deposited respectively on the opposing surfaces thereof, the method comprising the steps of:

dividing a scanning period during which one of the R, G, and B colors of light is emitted into first and second periods substantially equal in length, the first period including a selection period and a non-selection period;

determining a display state during said selection period of the first period;

holding the display state determined during said selection period of the first period through the non-selection period of the first period; and forcing said display state into a black display state in the second period constituting the remainder of said scanning period.

8. A method of driving the ferroelectric liquid crystal display as claimed in claim 7, wherein said ferroelectric liquid crystal has a first stable state and a second stable state which is entered when a voltage of opposite polarity is applied, and wherein a voltage value of a composite voltage waveform produced by compositing a scanning voltage waveform and a signal voltage waveform applied during a selection period in said second period is equal to or greater than a threshold voltage value at which said ferroelectric liquid crystal makes a transition to said first or said second stable state.

9. A method of driving the ferroelectric liquid crystal display as claimed in claim 7, wherein a signal voltage waveform applied during said second period is always set as a black display producing signal voltage waveform.

10. A method of driving a ferroelectric liquid crystal display, ferroelectric liquid crystal display comprising a ferroelectric liquid crystal display element and a light source which sequentially emits R, G, and B colors of light, the ferroelectric liquid crystal display element including a ferroelectric liquid crystal that is sandwiched between a pair of substrates having N scanning electrodes and M signal electrodes deposited respectively on the opposing surfaces thereof, the method comprising the steps of:

dividing a period during which one of the R, G, and B colors of light is emitted into even number of scanning periods;

in an odd-numbered scanning period, performing one of forward scanning and backward scanning; and in an even-numbered scanning period, performing the other of the forward scanning and the backward scanning, wherein the forward scanning is performed by scanning said scanning electrodes forward, starting at the first scanning electrode and progressing toward the N-th scanning electrode and the backward scanning is performed by scanning said scanning electrodes backward, starting at the N-th scanning electrode and progressing toward the first scanning electrode.

11. A method of driving the ferroelectric liquid crystal display as claimed in claim 10, wherein in said odd-numbered scanning period, the forward scanning is performed and, in said even-numbered scanning period, the backward scanning is performed.

* * * * *